United States Patent [19]

Shaffer

[11] 4,232,055

[45] Nov. 4, 1980

[54] AUTOMATIC COLOR CHANGE ELECTROSTATIC PAINT SPRAY SYSTEM

[75] Inventor: Donald O. Shaffer, Temperance, Mich.

[73] Assignee: Champion Spark Plug Company, Toledo, Ohio

[21] Appl. No.: 32,790

[22] Filed: Apr. 24, 1979

[51] Int. Cl.[2] ..... B05B 5/02; B05D 1/04

[52] U.S. Cl. ..... 427/33; 118/624; 137/625.41; 239/3; 239/305; 427/421

[58] Field of Search ..... 118/624, 625, 621, 302; 427/27, 33, 421; 239/3, 70, 304, 305; 137/567, 625.4, 625.41

[56] References Cited

U.S. PATENT DOCUMENTS

| | | | |
|---|---|---|---|
| 3,348,774 | 10/1967 | Wiggins | 239/70 |
| 3,450,092 | 6/1969 | Kock | 118/302 |
| 3,558,051 | 1/1971 | Strickler et al. | 239/305 |
| 3,674,207 | 7/1972 | Carbonetti et al. | 239/305 |
| 3,857,513 | 12/1974 | Wiggins | 239/70 |
| 3,870,233 | 3/1975 | Wilhelm et al. | 239/305 |
| 3,981,320 | 9/1976 | Wiggins | 239/3 |
| 4,163,523 | 8/1979 | Vincent | 239/305 |

*Primary Examiner*—John H. Newsome
*Attorney, Agent, or Firm*—Oliver E. Todd, Jr.

[57] ABSTRACT

An improved method and apparatus is disclosed for sequentially electrostatic spraying different ones of a plurality of electrically conductive paints from a plurality of paint sources. Each paint source is connected through a separate electrically non-conductive first hose to a manifold and then through a single second hose to a spray gun. After spraying, at least the first hose which carries the sprayed paint is purged of paint and dried to electrically isolate the source of the first paint from the manifold when a second paint is sprayed.

7 Claims, 5 Drawing Figures

AUTOMATIC COLOR CHANGE ELECTROSTATIC PAINT SPRAY SYSTEM

BACKGROUND OF THE INVENTION

This invention relates to fluid spraying and more particularly to an improved electrostatic spray painting system capable of automatic painting work pieces with different colored electrically conductive paints.

In production lines and similar applications, it is desirable to have a paint system capable of painting successive work pieces such as automotive bodies different colors as they are conveyed past a spray station. As a consequence, both manual and automatic systems have been developed for changing color as successive work pieces are painted. In many applications, it is also desirable to use an electrostatic coating system. Electrostatic spray painting has many advantages including producing a more uniform coating on irregular surfaces and reducing the amount of paint needed to coat a work piece. Many problems have occurred in attempting to combine a color change system with an electrostatic system. Many of the problems are aggravated when an electrically conductive paint is to be sprayed.

When an electrostatic spray system is operated with an electrically conductive paint, it is necessary to electrically isolate from ground the entire column of paint from the spray gun to its supply tank or source. In a color change system, it is further necessary to isolate from ground each of the individual colored paints. Where the system permits all of the paint to be charged from the spray gun back to their source, it is not possible to perform maintainance work on any portion of the system while the spray gun is in operation. For example, while the system is painting work pieces with red paint, it is not possible to fill a different color tank, such as the green paint tank, with additional paint. Problems also occur from electrical capacitance of a color change system. Where tanks of different colored paints, paint hoses and color selection valves are added to a system, the electrical capacitance is greatly increased. This higher electrical load is often sufficient to prevent the high voltage power supply from maintaining a desired potential at the spray gun. Furthermore, the higher capacitance will store more electrical energy and, therefore, present a greater hazard to workmen in the vicinity of the spray system.

U.S. Pat. No. 4,085,892 discloses an electrostatic spray system capable of handling a purality of different colored coating materials which are electrically conductive. This system operates with two sub-systems, one of which includes a source of each of the different colored paints maintained at ground potential and the other of which maintains tanks of the paints which are isolated from ground. The isolated paints are all connected through paint hoses and manifolding to the spray gun and are all charged to a high voltage. Isolation is maintained between the two systems by pumping relatively small masses of paint or bursts of paints from the ground system across a relatively large air space into the electrically charged tanks. However, this system has a large electrical capacitance and, therefore, presents a high electrical load on the high voltage power supply. Also, maintainance personnel cannot work on the ungrounded tanks for any of the colors when the system is spraying a different color since all tanks are charged during spraying.

SUMMARY OF THE INVENTION

According to the present invention, an improved system is provided for selectively spraying a plurality of different color electrically conductive paints from an electrostatically charged spray gun. Only one of the conductive paints is connected to the spray gun at any given time so that only the source or supply tank for that paint is charged during spraying. When a spraying operation with a particular color is completed, the supply hoses or conduits for that paint, which are formed from an electrically insulating material, are purged of all paint residue and are dried so as to electrically insulate the supply tank from the spray gun. After the hoses are completely dried, the next paint is automatically supplied to the spray gun for the next spraying operation. The electrical capacitance load on the high voltage power source is restricted only to the supply hoses, the control valves and the supply tank for one color at any given time. Since the supply tank and related apparatus for the other colors are not electrically connected to the spray gun, an operator may fill the supply tank or perform other maintainance operations while one color is being sprayed without risk of electrical shock.

Accordingly, it is an object of the invention to provide an improved color change system capable of selectively spraying different colored electrically conductive paints from an electrostatic spray gun.

Another object of the invention is to provide a color change system for electrostatic spraying electrically conductive paints in which only the supply for a paint being sprayed is charged at any given time.

Another object of the invention is to reduce the electrical load on the high voltage power supply in a color change electrostatic spray system spraying electrically conductive paints.

Other objects and advantages of the invention will become apparent from the following detailed description, with reference being made to the accompanying drawings.

DESCRIPTION OF THE PREFERRED EMBODIMENT

Figure 1:
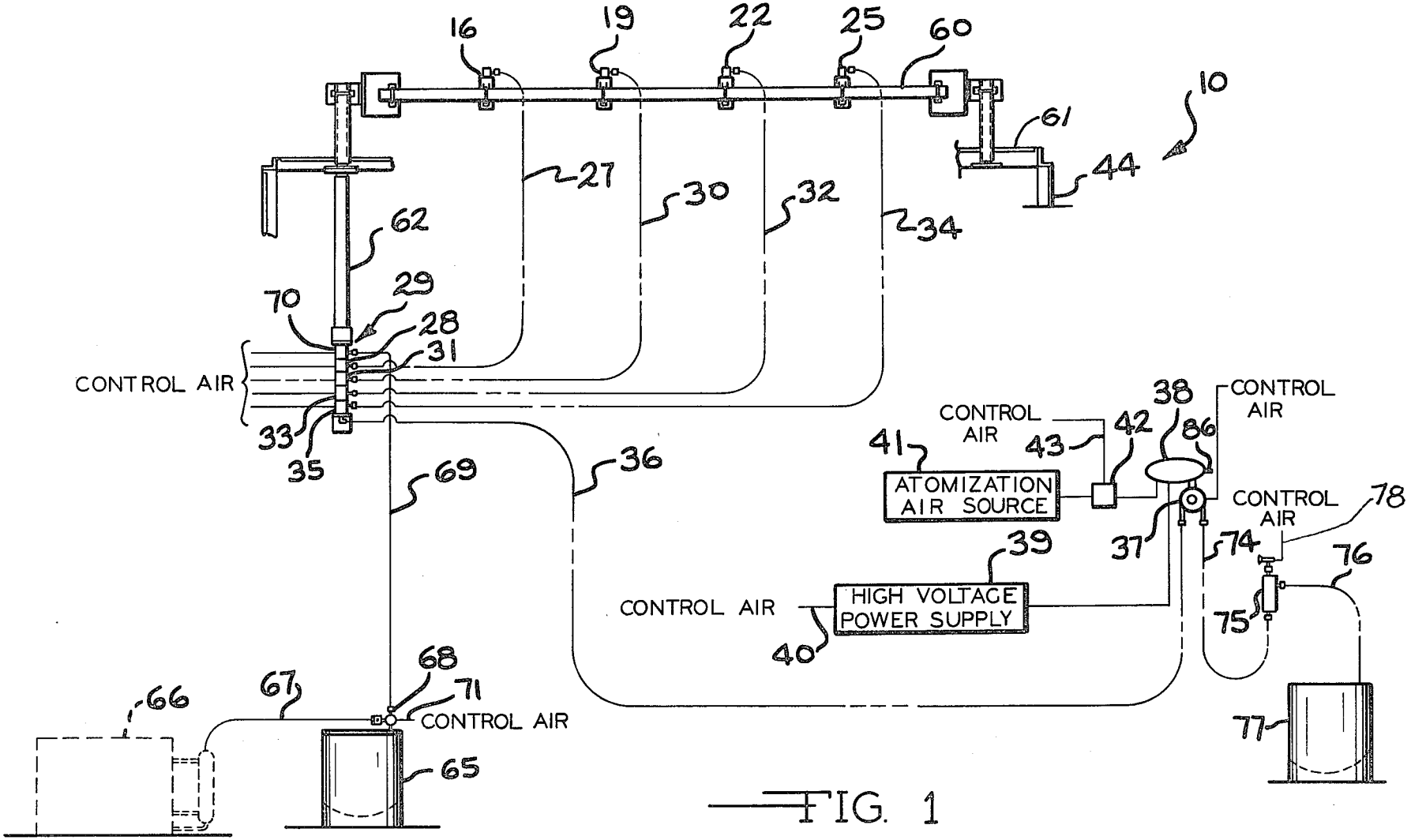
FIG. 1 is a fragmentary side elevational view of a color change system for selectively spraying different colored electrically conductive paint from an electrostatic spray gun in accordance with the present invention.
Figure 2:
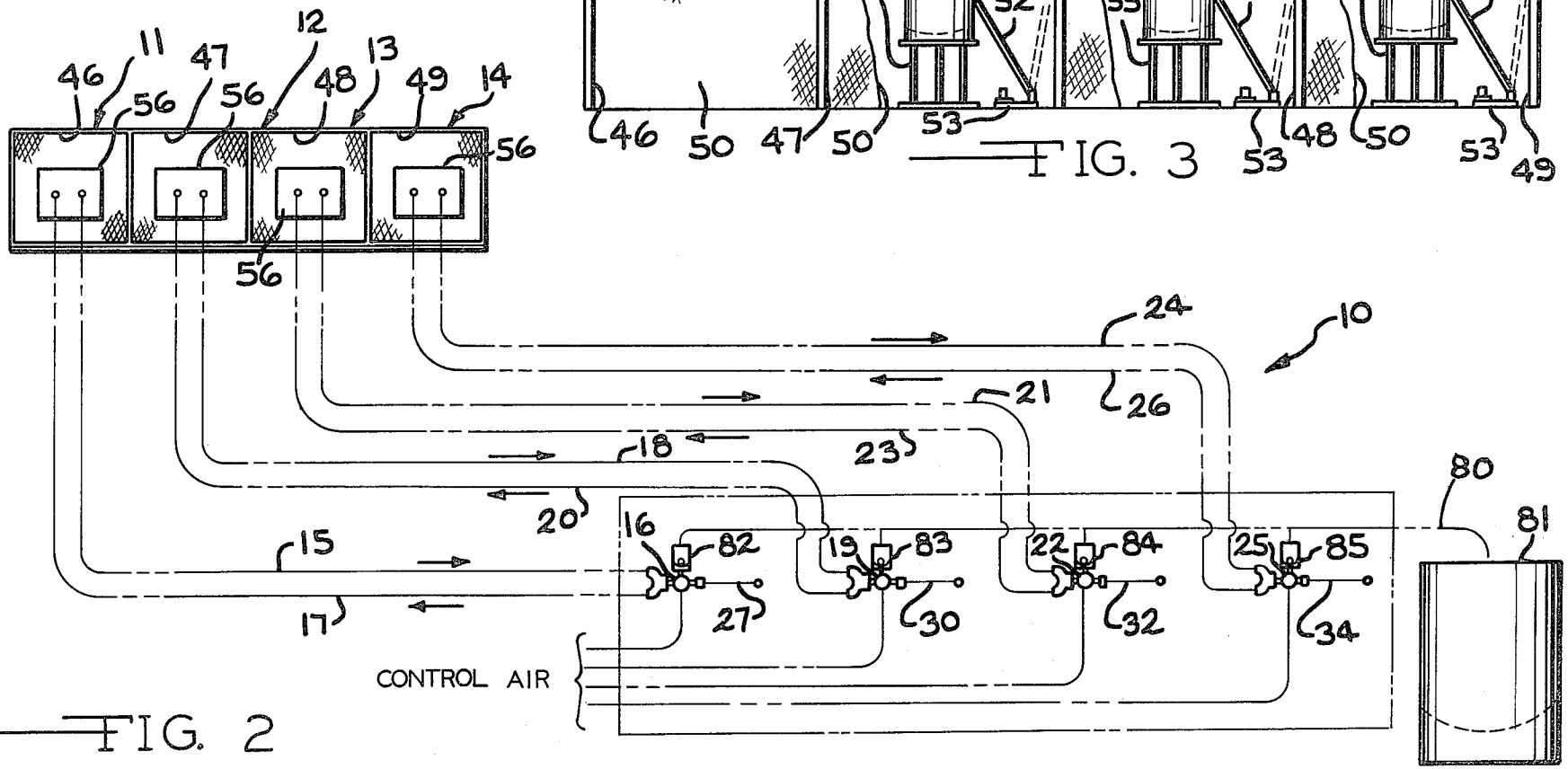
FIG. 2 is a fragmentary top plan view of the system of claim 1.

Turning now to the drawings and particularly to FIGS. 1 and 2, a color change paint spraying system 10 is illustrated in accordance with the present invention for electrostatic spraying of electrically conductive paint, such as water base paints or metallic paints. The system 10 is illustrated for selectively spraying any one of four different colored paint supplied from four paint sources 11–14. Of course, the principles of the system 10 may be adapted to systems with any desired number of paint sources. A recirculating system is illustrated with paint supplied from the source 11 through a hose 15 to a pilot valve 16 and unused paint then returns from the valve 16 back through a hose 17 to the source 11. Similarly, paint from the source 12 flows through a hose 18 to a pilot valve 19 and unused paint back through a hose 20 to the source 12; paint from the source 13 flows through hose 21 to a pilot valve 22 and unused paint is returned through a hose 23 to the source 13; and paint from the source 14 is circulated through a hose 24 to a pilot valve 25 and unused paint is returned through a hose 26 to the source 14. The recirculation paint supply systems continually stir the paints to maintain a uniform paint consistency.

The pilot valves 16, 19, 22, and 25 are three way valves. The pilot valve 16 is connected through a hose 27 to a valve 28 in a color change manifold 29. Similarly, the pilot valve 19 is connected through a hose 30 to a valve 31 in the color change manifold 29, the pilot valve 22 is connected through a hose 32 to a valve 33 in the color change manifold 29 and the pilot valve 25 is connected through a hose 34 to a valve 35 in the color change manifold 29. The color change manifold 29 is connected permanently through a hose 36 and a valve 37 to an electrostatic spray gun 38. By actuating the pilot valve 16, the manifold valve 28 and the valve 37, paint is supplied from the source 11 to the spray gun 38. Or, by actuating the pilot valve 19, the manifold valve 31, and the valve 37, paint is supplied from the source 12 to the spray gun 38. Actuation of the pilot valve 22, the manifold valve 33 and the valve 37 supplies paint from the source 13 to the spray gun 38 or actuation of the pilot valve 25, the manifold valve 35 and the valve 37 supplies paint from the source 14 to the spray gun 38.

The spray gun 38 may be of any conventional design and either hand held or automatic. In addition to the paint flowing through the hose 36 and the valve 37 to the spray gun 38, a high voltage is applied to the spray gun 38 from a high voltage power supply 39 which also is of conventional design. The high voltage power supply 39 generates a high voltage which may, for example, be on the order of from 20,000 volts to 100,000 volts, for charging atomized paint particles as they are discharged from the spray gun 38. The paint can be charged either in the gun or in the immediate vicinity of the gun. In the system 10, the high voltage power supply 39 is switched on and off by an internal pneumatic switch in response to the presence or absence of pressurized control air on a hose or line 40. Atomizing air also is supplied to the spray gun 38 from an atomizing air source 41. The atomizing air source 41 may, for example, comprise a conventional compressor. The atomizing air is supplied through a pneumatic valve 42 to the spray gun 38. The pneumatic valve 42 is controlled in response to the presence or absence of control air on a hose 43. When control air is simultaneously applied to the valve 37 to supply paint from the hose 36 to the spray gun 38, to the hose 40 to activate the high voltage power supply 39 and to the hose 43 for applying atomizing air from the source 41 to the spray gun 38, electrostatically charged atomized paint particles are discharged from the spray gun 38 to a work piece located within a spray booth 44. After spraying of the work piece is completed, the valve 37 is closed, the high voltage power supply 39 is turned off and the flow of atomizing air from the air source 41 is interrupted. During the spraying operation, one of the four paint sources 11–14 and the hoses connected between such paint source and the spray gun 38 will be electrically charged due to the conductivity of the paint. As is discussed in greater detail below, the others of the paint sources 11–14 will not be charged and, as a consequence, will not electrically load the high voltage power supply 39 since only one of the hoses 27, 30, 32 or 34 will contain conductive paint at any given time.

Figure 3:
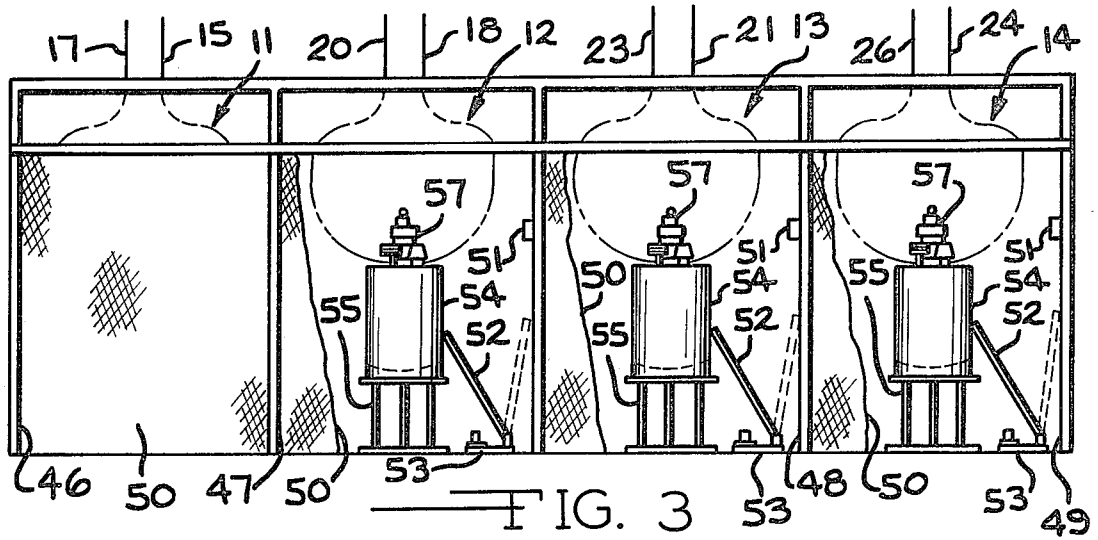
FIG. 3 is a partially broken away side elevational view showing paint supply tanks for four different colored paints.

Each of the paint sources 11–14 is electrically insulated from the other paint sources 11–14. Referring to FIGS. 2 and 3, each of the paint sources 11–14 is located within a separate electrically grounded cage 46–49, respectively. Each of the cages 46–49 has a door 50 which can be opened for performing routine maintainance tasks on the paint sources 11–14. The doors 50 for the cages 47–49 are shown broken away to illustrate details of the paint sources 12, 13 and 14 which are also typical of the paint source 11. Each of the cages 11–14 is provided with a door interlock switch 51. When a door 50 for any of the cages 46–49 is opened, the interlock switch 51 for such cage automatically grounds the paint source within the cage to eliminate any possible shock hazard to personnel servicing the paint source within the cage. The automatic grounding circuit includes a ground bar 52 provided within each of the cages 46–49. Each of the bars 52 is electrically grounded through a bracket 53. Each bar 52 is pivotally attached to a bracket 53 to pivot into and out of contact with a paint supply tank 54. Each paint supply tank 54 is mounted on an electrically insulating base 55. During normal operation of the system 10, paint is circulated from one of the supply tanks 54 to an associated pilot valve and thence through a hose and a manifold valve to the spray 38. At this time, paint within the hoses and the supply tank 54 are charged to a high potential due to the conductivity of the paint. While an operator is within one of the cages 46–49, a pneumatic cylinder automatically pivots the ground bar 52 into contact with the paint tanks 54 in that cage to maintain the tank 54 at ground potential and prevent possible shock hazard. Each pneumatic cylinder is operated in response to the interlock switch 51 at the adjacent cage door 50. In order to form a fail safe system, the ground bars 52 are spring loaded to contact the adjacent paint tanks 54. In the event of an electrical or pneumatic system failure, the ground bars will automatically ground the paint tanks 54. An electrically insulating panel 56 such as a plexiglass panel, is mounted in the top of each of the cages 46–49. The paint supply and return hoses 15, 17, 18, 20, 21, 23, 24 and 26 pass through the insulating panels 56 to further insulate paint within such hoses from ground.

During normal operation of the system 10, paint continuously flows from the supply tank 54 for the source 11 through the hose 15 to the pilot valve 16 and is returned through the hose 17 to the tank 54 within the cage 46. Similarly, paint flows from the supply tank 54 within the cage 47 through the hose 18 to the pilot valve 19 and is returned through the hose 20 to such tank 54; paint flows from the supply tank 54 within the cage 48 through the hose 21 to the pilot valve 22 and is returned through the hose 53 to such tank 54; and paint flows from the supply tank 54 within the cage 49 through the hose 24 to the pilot 25 and returns through the hose 26 to such tank 54. Paint flow for each of the different colors between the source 11–14 and the associated pilot valves is maintained by a separate pump 57 which is mounted on each of the supply tanks 54. Each paint pump 57 electrically floats at the same potential as its associated paint source 11–14. If a circulating paint supply is not desired or necessary, the return hoses 17, 20, 23 and 26 can be eliminated. Also, the paint pumps 57 can be eliminated and the tanks 54 can be pressurized to cause paint to flow from the tanks 54 to the spray gun 38, if desired.

Referring again to FIGS. 1 and 2, the pilot valves 16, 19, 22 and 25 are mounted on an electrically insulating rod 60 which extends above the spray booth 44. The pilot valves are spaced a sufficient distance apart on the rod 60 to prevent arcing or shorting between adjacent valves. The hoses 27, 30, 32 and 34 from the valves 16, 19, 22 and 25 pass downwardly through a plexiglass panel 61 in the top of the spray booth 44 to the manifold valves 28, 31, 33 and 35, respectively. The valves 28, 31, 33 and 35 are electrically connected together and are insulated from ground by a support rod 62. Electrical isolation between the individual paint sources 11–14 is maintained by having a column of paint in only one of the hoses 27, 30, 32 and 34 between the pilot valves and the color change manifold 29 at any given time. The others of the hoses 27, 30, 32 and 34 are maintained, free of paint and in a dry state so as to form electrical insulators between the manifold valve 29 and the connected pilot valves. After a paint cycle is completed with a particular color paint from one of the sources 11–14, the portion of the system between the spray gun 38 and the manifold valve 16, 19, 22 or 25 for such particular color paint is completely purged of paint and dried before switching to the next color paint to maintain electrical isolation between the different paint sources 11–14.

Purging is accomplished with a suitable solvent from a pressurized tank 65 and with high pressure dry air from a source 66. The type of solvent within the tank 65 will depend upon the nature of the paint sprayed by the system 10. For water base paints, water is used as the solvent. The air source 66 provides low humidity, high pressure air for purging and drying the hoses in the system 10 during a purged cycle. The air source 66, for example, may include a refrigerated air dryer and a compressor for supplying compressed air at pressures on the order of 80 pounds per square inch. Dry, compressed air from the air source 66 is applied through a hose 67 to a three-way pilot valve 68. The pilot valve 68 also is connected to the solvent tank 65 and is connected through a hose 69 to a valve 70 on the color change manifold 29. By applying control air over a hose 71 to the three-way pilot valve 68, the pilot valve 68 is actuated to selectively connect and disconnect the solvent tank 65 and the dry air supply hose 67 to the hose 69. The hose 69 is of an electrically insulating material to isolate the manifold 29 from the solvent container 65 and the air source 66.

The spray gun valve 37 controls the flow of paint to the spray gun 38. Also the valve 37 is permanently connected through a hose 74, a dump valve 75 and a hose 76 to a waste container 77. The hoses 74 and 76 are of electrically insulating materials in order to electrically isolate the spray gun 38 from the valve 75 and the waste container 77. When the dump valve 75 is opened by control air on a hose 78 and solvent is applied through the valve 70 to the manifold 29, paint within the manifold 29, the hose 36 and the valve 37 is flushed to the waste containers 77. After flushing the hoses 36, 74 and 76 are dried by a flow of air from the source 66.

Each of the pilot valves 16, 19, 22 and 25 is a three-way valve which is connected through an insulated hose 80 to a waste container 81. The waste containers 77 and 81 may be separate, as shown, or they may be combined into a single container. A check valve 82 is positioned between the valve 16 and the hose 80, a check valve 83 is positioned between the valve 19 and the hose 80, a check valve 84 is positioned between the valve 22 and the hose 80 and a check valve 85 is positioned between the valve 25 and the hose 80. The check valves 82–85 are oriented to permit fluid flow from the valves 16, 19, 22 and 25, respectively, to the hose 80 while inhibiting a reverse fluid flow. When, for example, the manifold purge valve 70 is open and the manifold valve 28 also is open, purging fluid flows from the hose 69 through the manifold 29 and the hose 27, through the pilot valve 16, the check valve 82 and the hose 80 to the waste container 81. During such a purge cycle, a solvent is first applied to clean the manifold 29, the line 27, the pilot valve 16, and the hose 80 and then air is passed through these passages until they are thoroughly dry. When the passages are completely dry, the hose 27 forms an electrical insulator between the pilot valve 16 and the color changes manifold 29 to isolate the connected paint source 11 from the electrically charged portion of the system. The hose 80 is also an electrical insulator between the different pilot valves 16, 19, 22 and 25.

Figure 4:
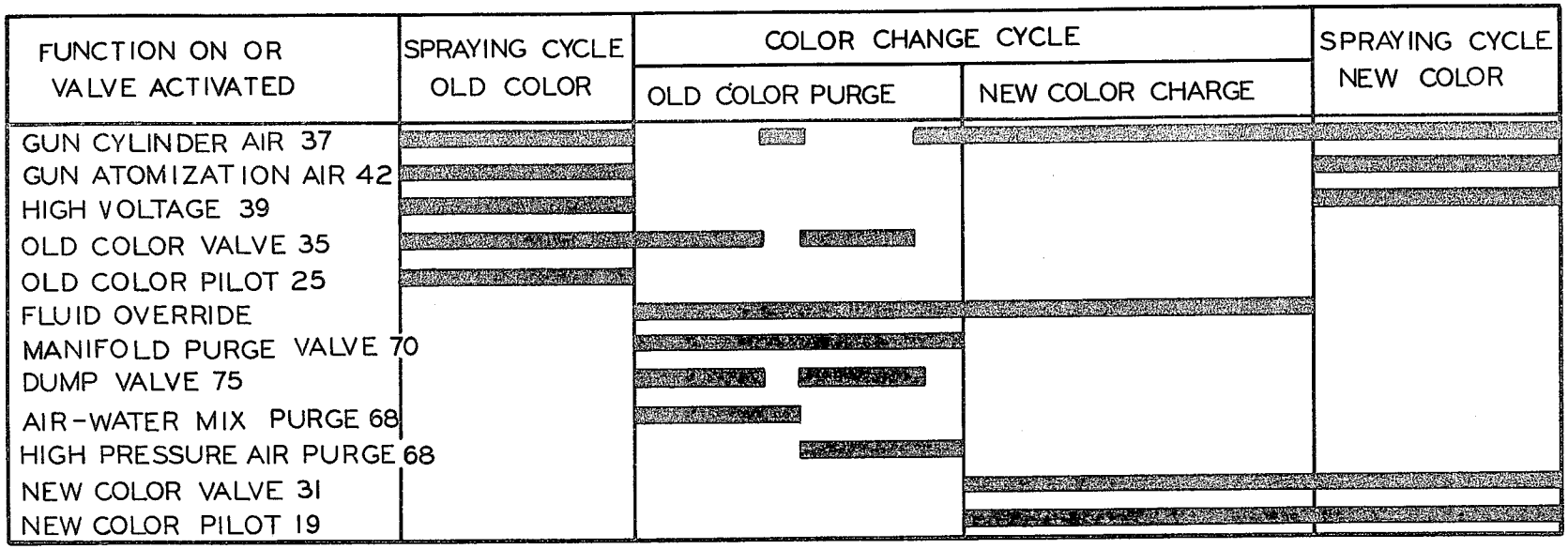
FIG. 4 is a timing chart showing the operating sequence of the system of the invention during a purge and color change cycle.

Referring now to FIGS. 1, 2 and 4, the different operating cycles of the spray system 10 are illustrated. Initially, the system 10 is assumed to be spraying paint from the source 14. Upon completion of this spraying operation, the system 10 is purged and a different color paint from the paint source 12 is supplied to the spray gun 38 for painting a work piece a different color. Of course, the same timing sequence applies when changing color between any two of the paint sources 11–14. In order to spray paint from the source 14 during the initial spraying cycle, control air is supplied to the pilot valve 25 to connect the paint supply hose 24 through the valve 25 and the hose 34 to the color change manifold 29. Control air also is applied to the manifold valve 35 to connect the hose 34 through the manifold 29 to the hose 36, and control air is applied to the valve 37 to connect the hoses 36 to the spray gun 38 for discharging paint toward a work piece in the booth 44. At the same time, control air is applied to the hose 43 to close the valve 42 to apply atomizing air to the spray gun 38 and control air is applied on the hose 40 to turn on the high voltage power supply 39. At this time, paint is supplied from the source 14 to the spray gun 38 and such paint is electrostatically charged, atomized and discharged from a nozzle 86 on the spray gun 38. Upon completion of the spraying cycle, the paint supply to the spray gun 38 is interrupted by releasing the valve 37, the atomization air is interrupted by closing the the valve 32, the high voltage is interrupted by turning off the high voltage power supply 39 and control air is removed from the pilot valve 25 to connect the hose 34 through the pilot valve 25 and the check valve 85 to the waste disposal hose 80. The color change valve 35 on the color change manifold 29 is maintained in its open position.

After spraying with paint from the source 14 is completed, a purge cycle is initiated by simultaneously opening the purge valve 70 on the color change manifold 29, opening the dump valve 75 connected between the spray gun paint supply valve 37 and the waste container 77, and applying control air on the hose 71 to the valve 68 to connect the solvent tank 65 to the color change manifold valve 70. At the same time, a fluid override circuit which is incorporated in the valve 37 is activiated to increase the flow rate from the hose 36 through the valve 37. An air-solvent mixture then flows from the tank 65 through the hose 69 and the valve 70 into the color change manifold 29, through the color change manifold 29 to the hose 36, through the valve 37, through the hose 74 and thence through the valve 75 and the hose 76 to the waste container 77. The air-solvent mixture also flows through the still open color change manifold valve 35, the hose 34, the pilot valve 25, and the check valve 85 to the hose 80 and thence to the waste container 81. Solvent flow is maintained until each of these valves and hoses is completely purged of the old color paint from the source 14. At this point, the dump valve 75 connecting to the waste container 77 is closed momentarily and the valve 37 is opened momentarily to allow the air-water solvent mixture to flow through the valve 37 and the spray gun 38 for purging the passages therein. After these passages are purged, control air is removed from the valve 37 and the dump valve 75 is again opened to connect the hose 74 from the spray gun valve 37 to the waste container 77. As much as 99% of the purged paint and solvent are collected in the waste containers 77 and 81. In other words, as little as 1% is discharged through the spray gun 38 during the purge cycle. At this point in time, all of the old paint from the source 14 is purged from the system downstream from the pilot valve 25 through the spray gun 38 and to the waste containers 77 and 81. These purged hoses and passages are then dried with air from the air source 66. This is accomplished by again opening the old color pilot valve 35 and the dump valve 75 and simultaneously applying control air to the pilot valve 68 to connect the dry air hose 67 to the hose 69. Pressurized dry air then flows through the color change manifold 29, the manifold valve 35, the hose 34, the three-way pilot valve 25, the check valve 85 and the hose 80 to thoroughly dry the passages therein. The dry, high pressure air also flows from the color change manifold 29 through the hose 36, the valve 37, the hose 34, the valve 75 and the hose 76 to the waste container 77 for drying these passages. After sufficient time has been allowed to dry the passages, the old color manifold valve 35 is closed, the dump valve 75 between the spray gun 38 and the waste container 77 is closed and the valve 37 at the spray gun 38 is activated to allow a short burst of dry air to pass through the valve 37 and the spray gun 38 to dry passages therein.

After the passages are dry, the manifold purge valve 70 is closed and the high pressure air and solvent valve 68 is closed to terminate the purging cycle. At this stage, the valve 37 remains activated to connect the paint hose 36 to the spray gun 38 and the fluid override signal is maintained to shorten the time required to fill the system with new paint from a different paint source, paint source 12 in this example. The system 10 is charged with a new color paint by closing the pilot valve 19 to connect the supply hose 18 for the paint from the source 12 to the line 30 and the color change manifold valve 31 is opened to connect the hose 30 to the hose 36 leading to the spray gun 38. This condition is maintained until the system 10 is charged with the newly selected paint from the source 12, at which time the fluid override signal is interrupted. Once the system 10 is charged with the newly selected paint from the source 12, spraying is begun by opening the valve 42 to supply atomizing air to the spray gun 38 and simultaneously energizing the high voltage power supply 39 with control air applied to the hose 40. The various valves are then maintained in their present state until spraying with the newly selected color from the source 12 is completed. During this spraying operation, the prior paint source 14 is isolated from the electrostatically charged paint between the source 12 and the spray gun 38 since all traces of paint and moisture have been removed from the hose 34 between the color change manifold 29 and the pilot valve 25. The hoses 27 and 32 between the color change manifold 29 and the pilot valve 16 and 22, respectively, also are clean and dry so as to form an insulator between the charged paint and the sources 12 and 13. The color change manifold 29 is isolated from the grounded valve 68, solvent tank 65 and air source 66 by the hose 69 which was dried during the purge cycle. The spray gun 38 and valve 37 are isolated from the valve 75 and the grounded waste container 77 by the hoses 74 and 76 which were purged and dried during the purge cycle. Similarly, the pilot valves 16, 19, 22 and 25 are isolated from each other and from the waste container 81 by the hose 80 which was dried during the purge cycle. As a consequence, the charged paint is isolated from ground and the sources 11, 13 and 14 do not electrically load the power supply 39 while the paint 12 is being sprayed. Therefore, an operator or maintainance person may open the doors 50 to the cages 46, 48 and 49, for example, while paint is sprayed from the source 12 without danger of electrical shock.

Figure 5:
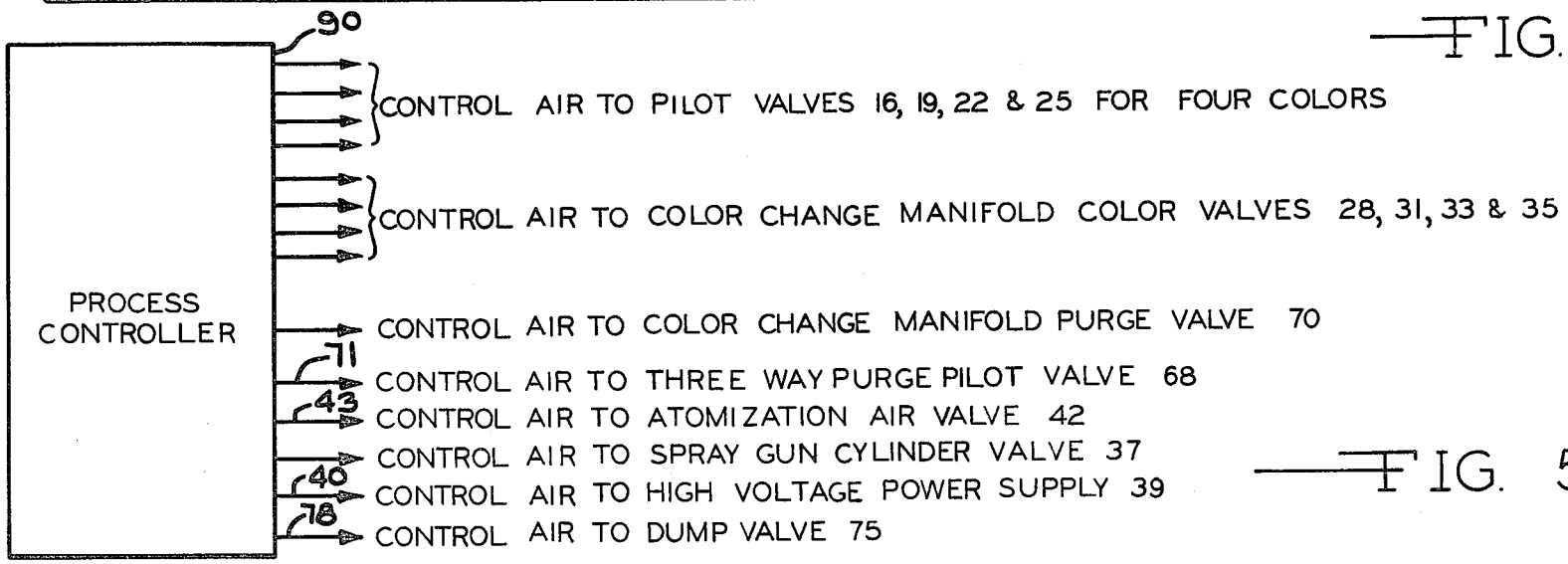
FIG. 5 is a block diagram showing a process controller for supplying control air to the different valves in the system of the present invention.

The color change cycle described above and illustrated in the timing chart of FIG. 4 may be accomplished by an operator manually actuating valves in the proper sequence. Or, preferably, an automatic process controller 90, as shown in FIG. 5, may be provided. The process controller 90 can be in the form of a programmed computer which sequentially closes valves to supply control air to the pilot valves 16, 19, 22 and 25, to the valves in the color change manifold 29, to the valve 37 at the spray gun 38, to atomization air source control valve 42, to energize the high voltage power supply 39, to the dump valve 75 and to the solvent and air purge valve 68. In such an application, an operator may manually supply paint color data to the process controller 90 as different work pieces enter the spray booth 44. Or, an automatic control signal can be supplied to the controller 90 in response to the detection of a work piece of a predetermined type entering the spray booth 44. If there is not change in the color of the work piece from the immediately preceding piece, then the process controller 90 is programmed to maintain the valves in their previously actuated conditions. If the next work piece is to be sprayed with a different color, then the process controller 90 automatically cycles through the purge cycle and color change cycle described above and shown in the timing chart of FIG. 4. Upon completion of the purge and new color change cycle, the spray gun 38 is automatically actuated by the process controller 90 to spray the new work piece with the newly selected color.

Preferably, all of the paint and solvent carrying hoses in the system 10 are of an electrically insulating material, such as polyethylene. The dry insulated hoses not only form an insulator between the valve and other apparatus connected to the ends of the hoses, but they also help to insulate from ground electrically charged fluid within the hoses. However, it should be noted that certain ones of hoses in the system 10 need not be of an insulating material, so long as these hoses are themselves insulated from ground. For example, the hoses 15 and 17 which continuously circulate paint between the source 11 and the pilot valve 16 need not be of an insulating material because continuous paint flow within these hoses will maintain the valve 16 and the paint source 11 at the same potential. However, the hoses 15 and 17 must be electrically insulated from ground. This also applies to the hoses 18, 20, 21, 23, 24 and 26. It is desirable, though, to form all of these hoses from an insulating material for personnel safety. It also should be noted that it is not necessary to dry the manifold 29 or the hose 36 between the manifold 29 and spray gun 38 during a color change cycle since they will always carry conductive paint during a spraying cycle. However, drying the manifold 29 and hose 36 will prevent solvent contamination of the new paint at the beginning of a new spray cycle. Also, the hose 36 will be dried when pressurized dry air is supplied through the hose 36 to dry the hoses 74 and 76 between the spray gun 38 and waste container 77.

It will be appreciated that various changes and modifications may be made in the above-described preferred embodiment of a color change system 10 for selectively spraying different colored electrically conductive paint from an electrostatic spray gun without departing from the spirit and the scope of the following claims.

What I claim is:

1. A method for electrostatic spraying work pieces with an electrically conductive paint comprising the steps of:

supplying a first electrically conductive paint from a first paint source sequentially through first and second electrically insulated conduits to an electrostatic spray gun to coat one of the work pieces with such first paint;

interrupting paint flow through said first and second conduits;

purging all paint from said first and second conduits with a solvent;

drying at least said first conduit whereby said first conduit is electrically non-conductive; and supplying a second electrically conductive paint from a second paint source sequentially through a third electrically insulated conduit and said second conduit to said spray gun to coat another of said work pieces with such second paint whereby said non-conductive first conduit insulates said first paint source from paint in said second and third conduits while said second paint is being sprayed.

2. A method, as set forth in claim 1, wherein both of said first and second conduits are dried prior to supplying the second paint to said spray gun.

3. A method as set forth in claims 1 or 2, wherein said paint is purged from said first and second conduits by flowing the solvent through said first and second conduits and through at least one electrically insulated fourth conduit to at least one waste container, and including the step of drying said fourth conduit prior to supplying said second paint to said spray gun.

4. Apparatus for sequentially electrostatic spraying different ones of a plurality of electrically conductive paints from a plurality of paint sources comprising a plurality of electrically non-conductive first paint conduits, a like plurality of first valve means for selectively controlling a flow of paint from a different paint source to each of said first conduits, a second conduit, a plurality of second valve means for selectively connecting said first conduits to said second conduit, each of said paint sources having an associated first valve means, first paint conduit and second valve means, an electrostatic spray gun, means for applying paint from said second conduit to said spray gun, means for simultaneously opening the first and second valve means associated with a first pre-selected paint source whereby paint flows from said pre-selected source through said associated first conduit and said second conduit to said spray gun, means for purging paint with a paint solvent from said first conduit and said second valve means associated with said pre-selected source and from said second conduit and said spray gun, and means for purging such paint solvent from at least said first conduit associated with said pre-selected source to form an electrical insulator between said first and second valve means associated with said pre-selected source whereby, when paint from a different pre-selected source is subsequently supplied through said first valve means, said first conduit and said second valve means associated with said different pre-selected source, through said second conduit and said applying means to said spray gun, such paint from said different pre-selected source is insulated from electrical contact with paint from said first pre-selected source.

5. Apparatus for sequentially electrostatic spraying different ones of a plurality of electrically conductive paints from a plurality of paint sources, as set forth in claim 4, wherein said solvent purging means includes means for purging such solvent from said second valve means associated with said pre-selected source and from said second conduit.

6. Apparatus for sequentially electrostatic spraying different ones of a plurality of electrically conductive paints from a plurality of paint sources, as set forth in claim 5, wherein said second valve means are mounted on a manifold having an outlet connected to said second conduit, wherein said paint purging means includes means for applying solvent under pressure to said manifold, such applied solvent flowing from said manifold through said second conduit and through any open second valve means and the first conduit associated with such open second valve means, and wherein said solvent purging means includes means for applying dry pressurized air to said manifold, such air flowing from said manifold through said second conduit and through such open second valve means and such first conduit associated with such open second valve means.

7. Apparatus for sequentially electrostatic spraying different ones of a plurality of electrically conductive paints from a plurality of paint sources, as set forth in claim 6, and further including a third electrically non-conductive conduit connecting from said spray gun to a waste container, third valve means for controlling fluid flow in said third conduit, means for opening said third valve means while solvent is applied to said manifold by said paint purging means and while dry air is applied to said manifold by said solvent purging means, said third conduit carrying paint, solvent and air from said spray gun to said waste container when said third valve means is opened, a fourth electrically non-conductive conduit connecting from each of said first valve means to a waste container, each of said first valve means including means for connecting the associated first conduit to said fourth conduit when such first conduit is not receiving paint from the associated paint source whereby purged paint, solvent and pressurized air applied from said manifold to a first conduit flows from such first conduit through said third conduit to said connected waste container.

* * * * *